US007567773B2

(12) United States Patent
Kato et al.

(10) Patent No.: US 7,567,773 B2
(45) Date of Patent: Jul. 28, 2009

(54) DEVELOPER VESSEL

(75) Inventors: Masanori Kato, Kanagawa (JP); Tomoyoshi Chihara, Kanagawa (JP); Naoya Iwata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/488,188

(22) Filed: Jul. 18, 2006

(65) Prior Publication Data

US 2007/0189808 A1 Aug. 16, 2007

(30) Foreign Application Priority Data

Feb. 14, 2006 (JP) ..... 2006-036707

(51) Int. Cl.
*G03G 15/01* (2006.01)
*G03G 15/09* (2006.01)

(52) U.S. Cl. ..... 399/227; 399/104; 399/254

(58) Field of Classification Search ..... 399/227, 399/119, 252, 256, 258, 104, 112
See application file for complete search history.

(56) References Cited

U.S. PATENT DOCUMENTS 5,852,759 A * 12/1998 Vackier et al. ..... 399/258
6,501,915 B2 * 12/2002 Yamashita ..... 399/227
7,016,630 B2 * 3/2006 Yoshizaki et al. ..... 399/258
2004/0184838 A1 * 9/2004 Ikeda et al. ..... 399/227
2004/0223788 A1 * 11/2004 Awaya ..... 399/227
2005/0180780 A1 * 8/2005 Obuchi et al. ..... 399/227
2006/0216067 A1 * 9/2006 Okoshi ..... 399/258

FOREIGN PATENT DOCUMENTS

JP 06-208298 A * 7/1994
JP A-2000-056568 2/2000
JP A-2000-098715 4/2000
JP A-2005-156954 6/2005

* cited by examiner

*Primary Examiner*—Sophia S Chen
(74) *Attorney, Agent, or Firm*—Morgan, Lewis & Bockius LLP

(57) ABSTRACT

A developer vessel having: a developing agent, a second developing agent holding chamber that holds the developing agent supplied to the developing agent supporter; a first developing agent holding chamber being adjacent to the second developing agent holding chamber; a first partition that divides the first and the second developing agent holding chambers and having a second and a third opening portion; a first and a second carrying member that cause the developing agent to circulate between the first and the second developing agent holding chambers via the opening portions; a toner holding chamber being adjacent to the first developing agent holding chamber and facing the second developing agent holding chamber, and holds the toner supplied to the first developing agent holding chamber; and a second partition that has a first opening portion and divides the first developing agent holding chamber and the toner holding chamber.

6 Claims, 6 Drawing Sheets

DEVELOPER VESSEL

BACKGROUND

1. Technical Field

The present invention relates to techniques for agitating and carrying a developing agent contained in development apparatuses.

2. Related Art

In electrophotographic image forming apparatuses such as copier machines, printing devices, facsimile devices, and multifunction devices that contain such apparatuses, a development process is executed while a two-constituent developing agent containing a non-magnetic toner and a magnetic carrier is agitated and carried inside a cylindrical developer vessel. Generally, in image forming apparatuses in common use, a carrying member for carrying the developing agent, which is fitted inside the developer vessel, is rotated in a rotational axis direction. Examples of the carrying member are an auger, in which spiral shaped vanes are provided on the perimeter of a rotation shaft, and a coil shaped carrying member carrying the developing agent is rotated in a rotational axis direction to agitate the developing agent.

SUMMARY

According to an aspect of the present invention, there is provided a developer vessel having: a developing agent supporter that supports a developing agent containing a toner and a carrier, a second developing agent holding chamber that holds a developing agent supplied to the developing agent supporter; a first developing agent holding chamber that holds a developing agent, the first developing agent holding chamber being housed adjacent to the second developing agent holding chamber; a first partition that divides the first and the second developing agent holding chambers, the first partition having a second and a third opening portion; a first and a second carrying member that cause a developing agent held in the first developing agent holding chamber and the second developing agent holding chamber to circulate between the first developing agent holding chamber and the second developing agent holding chamber by allowing the developing agent to pass through the second and the third opening portions; a toner holding chamber that holds a toner supplied to the first developing agent holding chamber, the toner holding chamber being housed adjacent to the first developing agent holding chamber, and arranged in a position facing the second developing agent holding chamber through the first developing agent holding chamber, and; a second partition that divides the first developing agent holding chamber and the toner holding chamber, the second partition having a first opening portion through which a toner supplied from the toner holding chamber to the first developing agent holding chamber passes, the developer vessel being used in a rotation type development apparatus in which plural developing agent supporters are arranged along a circumference of a rotatable body, and development is carried out by causing the rotatable body to rotate such that one of the plural developing agent supporters is moved to a position facing an image carrier.

BRIEF DESCRIPTION OF THE DRAWINGS

Embodiments of the present invention will be described in detail based on the following figures, wherein.

DETAILED DESCRIPTION

Figure 1:
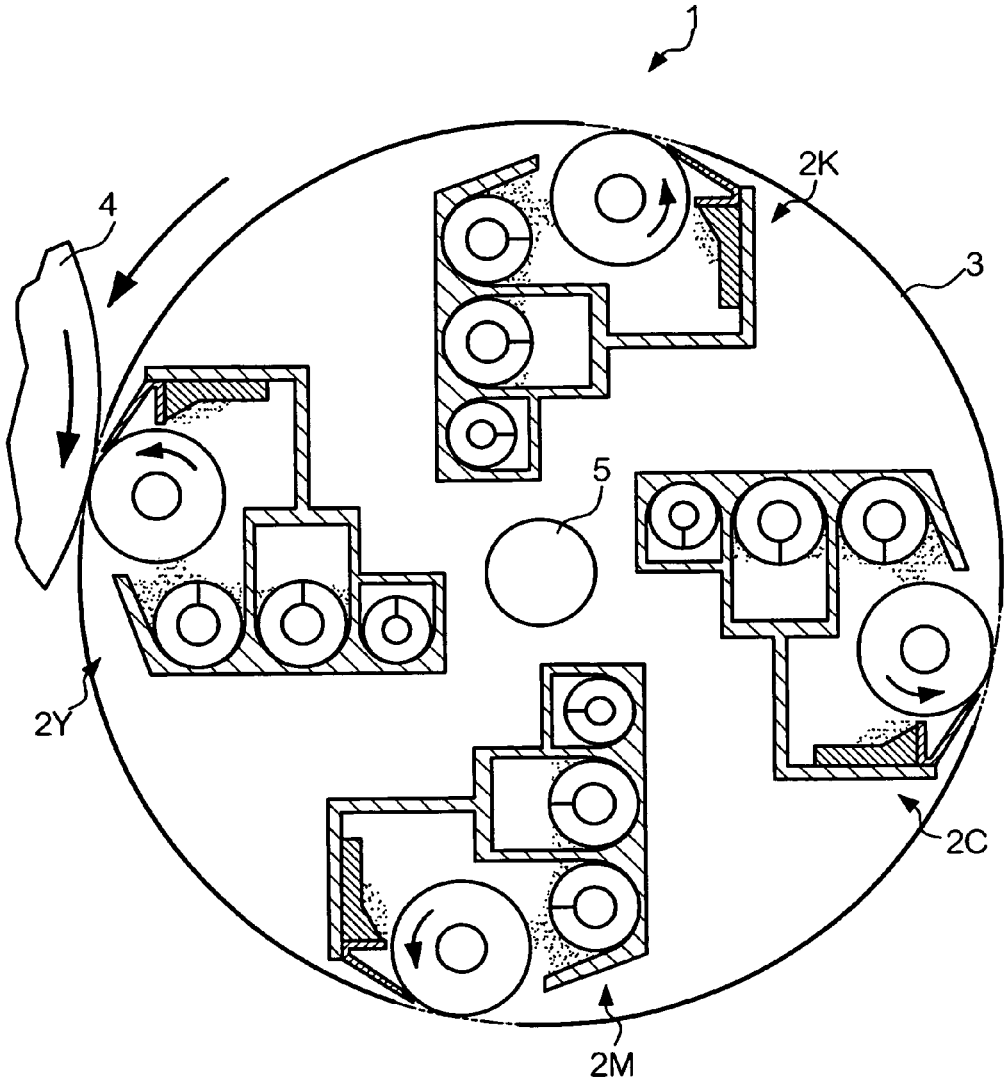
FIG. 1 shows a structure of a rotation type development apparatus according to an embodiment of the present invention.

FIG. 1 is a cross sectional view showing a structure of a rotation (rotary) type development apparatus 1 according to an embodiment of the present invention. The rotation type development apparatus 1 is provided with a rotatable body 3 capable of rotating in a counterclockwise direction on a rotation shaft 5 positioned centrally in the rotation type development apparatus 1. Four developer vessels 2Y, 2M, 2C, and 2K are arranged along a circumference of the rotatable body 3. More specifically, four arm portions (omitted from drawing) are arranged on the rotation shaft 5 extending in a radial direction at 90 degree angles and the developer vessels 2Y, 2M, 2C, and 2K are fastened to these arm portions respectively. Two-constituent developing agents (other additives and the like may also be added) of yellow (Y), magenta (M), cyan (C), and black (K), which include a non-magnetic toner and a magnetic carrier, are contained in the developer vessels 2Y, 2M, 2C, and 2K. By rotating the rotatable body 3, the rotation type development apparatus 1 causes one of the developer vessels 2Y, 2M, 2C, and 2K to move to a development position facing a photosensitive drum 4, which is an image carrier. Then, an electrostatic latent image, which has been formed on a surface of the photosensitive drum 4 by a commonly known exposure process, is developed by the developer vessel in the position facing the photosensitive drum 4.

Next, a structure of the developer vessels 2Y, 2M, 2C, and 2K will be described with reference to FIGS. 2 to 4. It should be noted that since the developer vessels 2Y, 2M, 2C, and 2K are all structured in the same way, description will be given here using as an example the yellow (Y) developer vessel 2Y that is positioned in the development position of FIG. 1.

Figure 2:
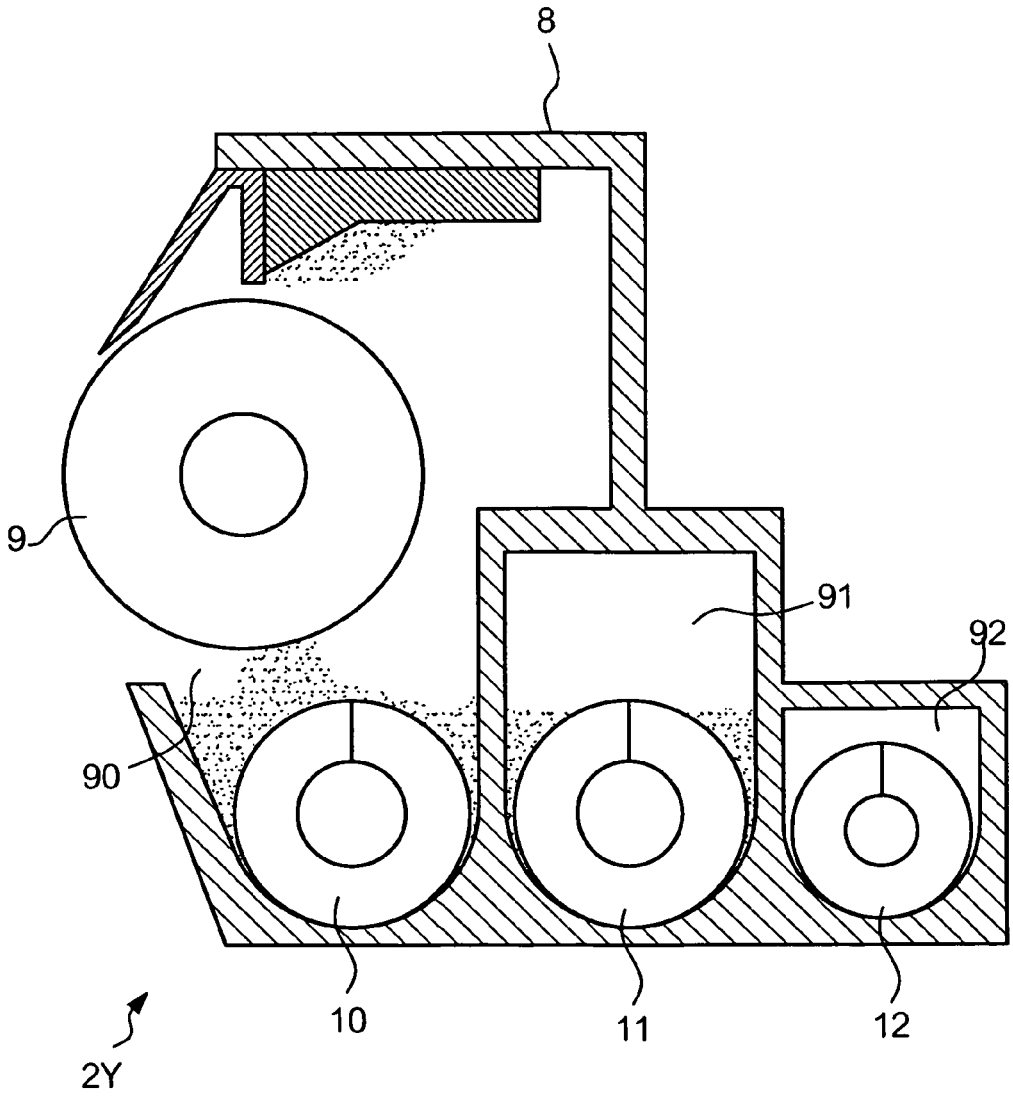
FIG. 2 is a cross sectional view of a developer vessel.

As shown in the enlarged view of FIG. 2, a development roll 9 is provided inside a developer vessel 8 as a developing agent supporter extending along a direction vertical to the paper plane so that a portion thereof is exposed on the peripheral surface of the rotatable body 3. A tubular developing agent holding chamber 90 (second developing agent holding chamber) and a developing agent holding chamber 91 (first developing agent holding chamber), which extend parallel to an axial direction of the development roll 9 and hold a developing agent, are arranged in the vicinity of the development roll 9. Moreover, a tubular toner holding chamber 92, which extends parallel to the axial direction of the development roll 9 and holds a toner, is arranged at a rear surface side (side facing the center of the rotatable body 3) of the developing agent holding chamber 91. As will be described later, the holding space of the developing agent holding chamber 90 and the holding space of the developing agent holding chamber 91 are linked via an opening portion, and the holding space of the developing agent holding chamber 91 and the holding space of the toner holding chamber 92 are linked via an opening portion. By providing the toner holding chamber 92, a certain amount of toner can be stored in the holding space, such that it becomes unnecessary to arrange a separate reserve tank, and the structure of the rotation type development apparatus 1 is simplified.

Mounted inside each of the developing agent holding chambers 90 and 91 and the toner holding chamber 92 respectively are a supply auger 10 (second carrying member), an agitating auger 11 (first carrying member), and a dispensing auger 12 (toner carrying unit), extending in a direction vertical to the paper plane. An "auger" refers to a member in which a spiral vane or multiple parallel board-shaped vanes are provided around the perimeter of a rotating shaft. The dispensing auger 12 carries a toner supplied from a toner cartridge not shown in the drawing in the toner holding chamber 92 from a frontward side of the paper plane to an inner side of the paper plane and supplies the toner to the developing agent holding chamber 91. The amount of toner supplied to the developing agent holding chamber 91 is regulated by the rotation time of a dispense motor (omitted from drawing) according to a toner concentration sensor (omitted from drawing). In the developing agent holding chamber 91, while mixing the toner that has been discharged from the toner holding chamber 92 with the developing agent, the agitating auger 11 agitates and carries it from an inner side of the paper plane to a frontward side of the paper plane and discharges it to the developing agent holding chamber 90. In the developing agent holding chamber 90, while agitating and carrying from a frontward side of the paper plane to an inner side of the paper plane the developing agent that has been discharged from the developing agent holding chamber 91, the supply auger 10 uniformly supplies the developing agent to the surface of the development roll 9. The development roll 9 rotates in a counterclockwise direction while the carrier in the developing agent (and the toner adsorbing to the carrier) is made to adsorb to the roll surface by magnetic force due to a magnet roll (omitted from drawing) mounted therein, and carries the developing agent to the development region facing the photosensitive drum 4. Then, the electrostatic latent image formed on the photosensitive drum 4 is transformed to a manifest image by the developing agent on the surface of the development roll 9. The developing agent in the developing agent holding chamber 90 that was not supplied to the development roll 9 is made to return from the developing agent holding chamber 90 to the developing agent holding chamber 91. That is, the developing agent is agitated by the two augers 10 and 11 in the developer vessel 2Y while being carried in a circular manner along a lengthwise direction (rotational axis direction of the development roll 9) of the developing agent holding chambers 90 and 91.

Figure 3A:
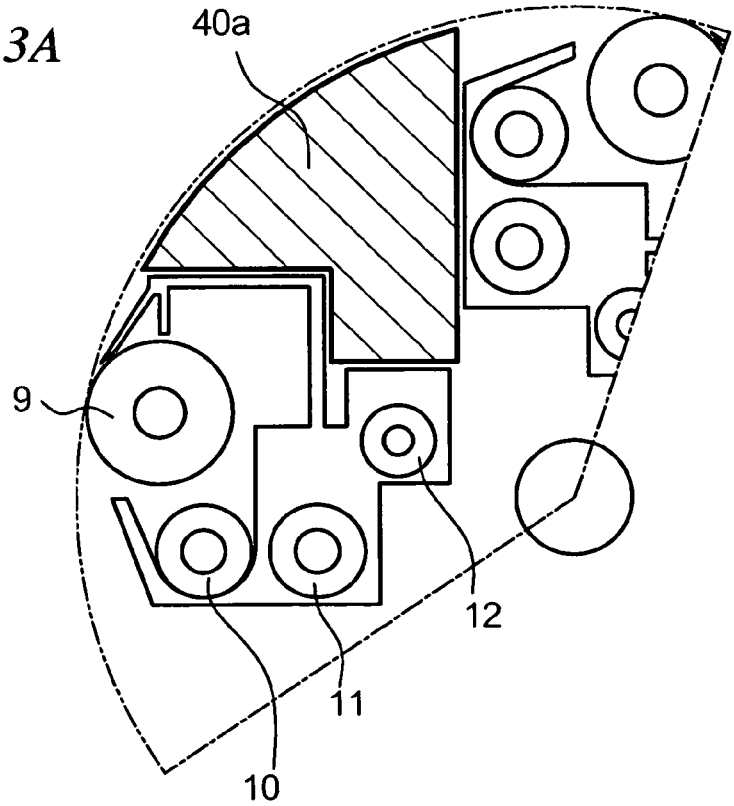
FIGS. 3A and 3B are for describing a relationship between a cross sectional form of the developer vessel and a cross sectional surface area of a toner cartridge.
Figure 3B:
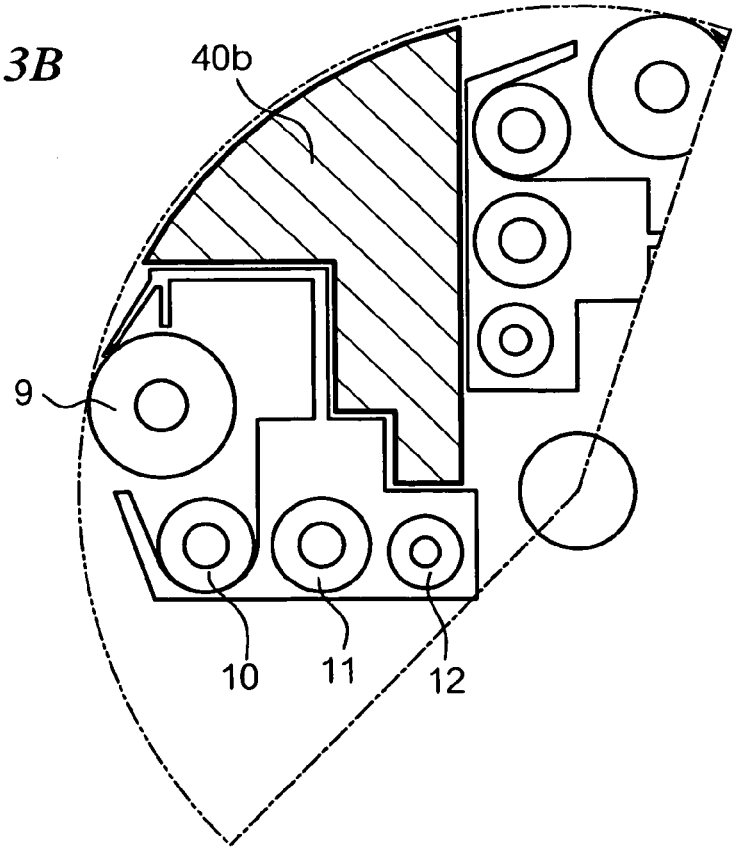

The developing agent holding chambers 90 and 91 and the toner holding chamber 92 may be positioned on substantially the same plane. Namely, the developing agent holding chamber 90 and the developing agent holding chamber 91 are adjacent to each other and the developing agent holding chamber 91 and the toner holding chamber 92 are adjacent to each other, and moreover, the toner holding chamber 92 is arranged in a position facing the developing agent holding chamber 90 sandwiching the developing agent holding chamber 91. For example, when the developing agent holding chambers 90 and 91 and the toner holding chamber 92 are not positioned on substantially the same plane as shown in FIG. 3A, the space of a toner cartridge 40*a* for replenishing the toner is compressed by the holding chambers 90 to 92 such that a sufficient capacity cannot be secured. Accordingly, in this case, it is inevitable that the space occupied by a toner cartridge is secured by increasing the overall size of the rotation type development apparatus 1. In contrast to this, when the developing agent holding chambers 90 and 91 and the toner holding chamber 92 are positioned on substantially the same plane as shown in FIG. 3B, none of the developing agent holding chambers 90 and 91 or the toner holding chamber 92 is intrusive, and therefore the capacity of a toner cartridge 40*b* may be adequately secured.

Figure 4:
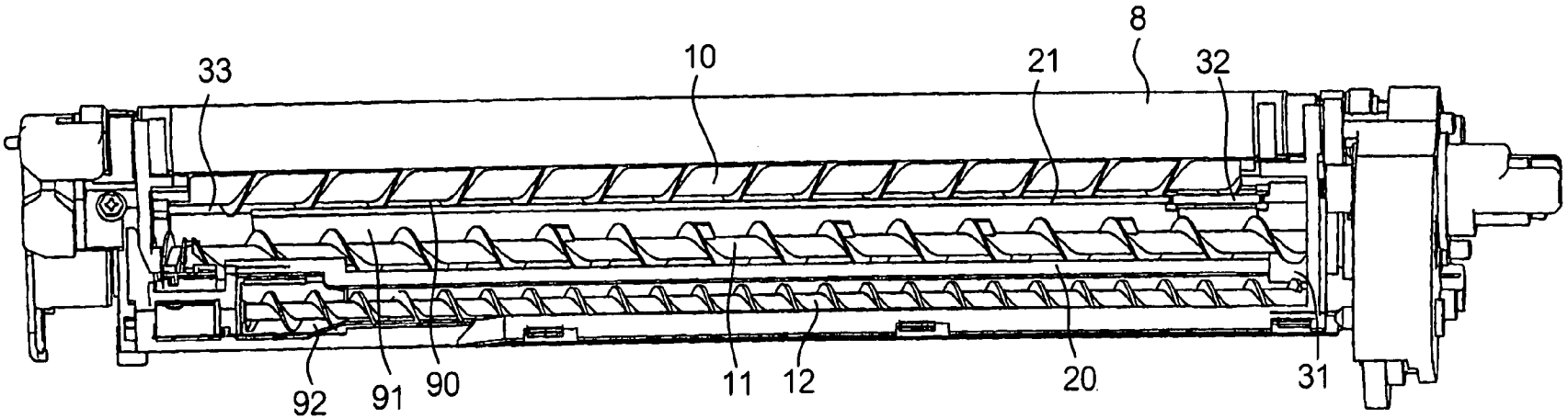
FIG. 4 is a top view of the developer vessel in which a cover that covers the developing agent holding chambers and a toner holding chamber is removed, as viewed from above in FIG. 2.

Next, FIG. 4 is a top view of the developer vessel 2Y in which a cover that covers the developing agent holding chambers 90 and 91 and the toner holding chamber 92 is removed, as viewed from above in FIG. 2. As shown in FIG. 4, a first opening portion 31 is provided in a partition 20 (first partition) between the toner holding chamber 92 and the developing agent holding chamber 91. The holding space of the toner holding chamber 92 and the holding space of the developing agent holding chamber 91 are linked via the first opening portion 31. Furthermore, a second opening portion 32 and a third opening portion 33 are provided in a partition 21 (second partition) between the developing agent holding chamber 91 and the developing agent holding chamber 90. Here, the position closer to the first opening portion 31 is set as the position of second opening portion 32 and the farther position is set as the position of the third opening portion 33. The holding space of the developing agent holding chamber 91 and the holding space of the developing agent holding chamber 90 are linked via the second opening portion 32 and the third opening portion 33. The dispensing auger 12 carries the toner in the toner holding chamber 92 from the left side in the drawing to the right side and discharges the toner from the first opening portion 31 to the developing agent holding chamber 91. The agitating auger 11 mixes the toner discharged from the first opening portion 31 with the developing agent while agitating and carrying this from the right side in the drawing to the left side (in a direction from the second opening portion 32 to the third opening portion 33) and discharges from the third opening portion 33 to the developing agent holding chamber 90. The supply auger 10 agitates and carries the developing agent discharged from the third opening portion 33 and uniformly supplies the developing agent to the surface of the development roll 9, and also discharges the developing agent that was not supplied to the development roll 9 from the second opening portion 32 to the developing agent holding chamber 91. That is, the developing agent in the developing agent holding chambers 90 and 91 is circulated clockwise.

As described above, by providing the toner holding chamber 92 and positioning the developing agent holding chambers 90 and 91 and the toner holding chamber 92 on substantially the same plane, a toner holding unit such as a reserve tank becomes unnecessary and an overall miniaturization of the rotation type development apparatus 1 can be achieved. However, on the other hand, problems such as the following exist.

Figure 5A:
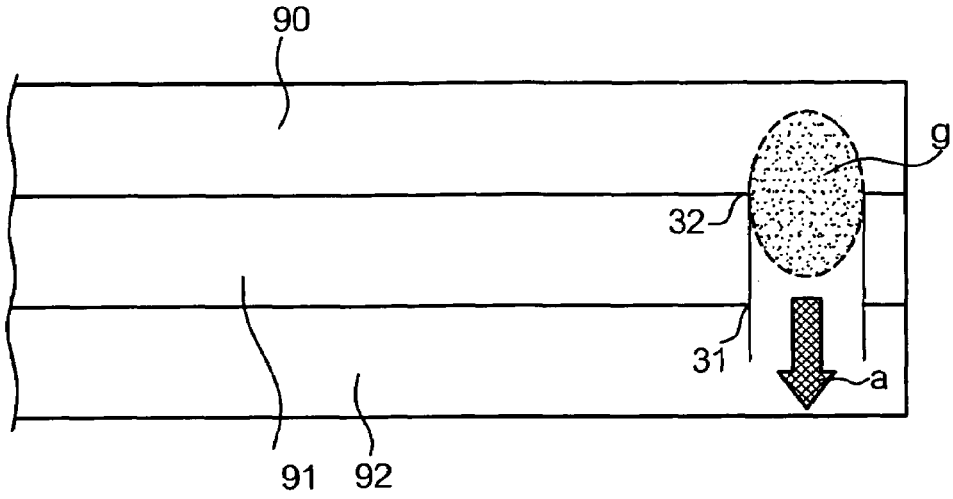
FIGS. 5A and 5B are for describing a backflow of a developing agent.
Figure 5B:
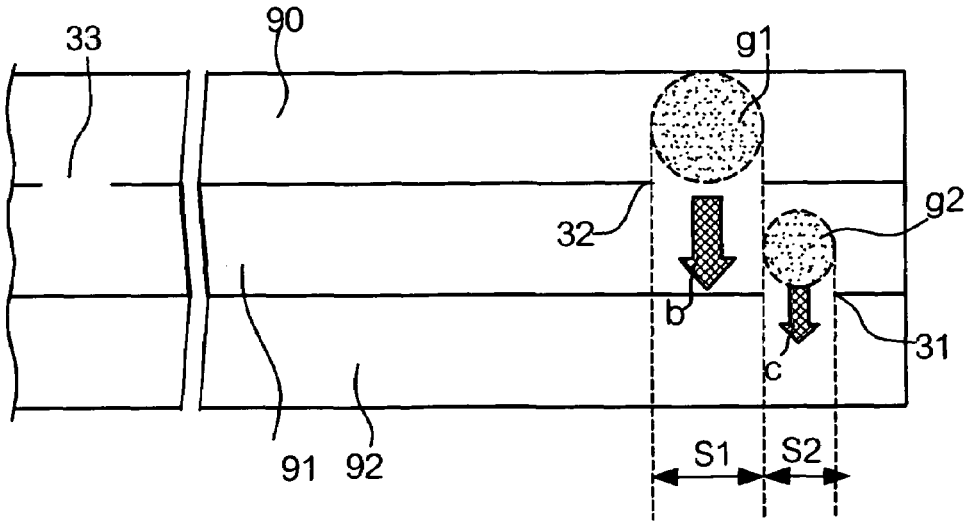

The rotation type development apparatus 1 rotates on a rotational shaft. When the developing agent holding chambers 90 and 91 and the toner holding chamber 92 are positioned on substantially the same plane, as shown in FIG. 5A that due to the rotation, a considerable amount of developing agent g positioned near the second opening portion 32 of the developing agent holding chambers 90 and 91 may backflow through the first opening portion 31 to the toner holding chamber 92 (arrow "a" in the drawing). According to an aspect of the present invention, the first opening portion 31 is provided on an opposite side to that of the third opening portion 33 when viewed from the position of the second opening portion 32 as shown in FIG. 5B. That is, a region S2 occupied by the first opening portion 31 in the lengthwise direction of the developing agent holding chamber 91 and the toner holding chamber 92 is arranged further outside (end portion side of the developing agent holding chamber 91 and the toner holding chamber 92) than a region S1 occupied by the second opening portion 32 in the lengthwise direction of the developing agent holding chambers 90 and 91, and these two regions have a positional relationship such that they do not overlap. By this arrangement, developing agent g1 positioned near the second opening portion 32 of the developing agent holding chamber 90 only enters the developing agent holding chamber 91 (arrow "b" in the drawing) even when the rotation type development apparatus 1 rotates.

However, there is a risk that developing agent g2 positioned near the first opening portion 31 of the developing agent holding chamber 91 will backflow through the first opening portion 31 into the toner holding chamber 92 (arrow "c" in the drawing). Although the amount of developing agent near the second opening portion is extremely large due to the influence of the developing agent that has been discharged from the developing agent holding chamber 90, the amount of developing agent is small on the outer side (end portion side of the developing agent holding chamber 91) of the second opening portion. The first opening portion 31 is provided, not in a position in which the amount of developing agent is extremely large as described above, but in a position such that the toner is discharged in a region (region S2 in FIG. 5B) where there is less developing agent than in other regions inside the developing agent holding chamber 91, and therefore even if the developing agent backflows through the first opening portion 31 into the toner holding chamber 92, the amount thereof is small and therefore does not become a major problem.

Furthermore, by providing the first opening portion 31 on a side opposite to the third opening portion 33 when viewed from the position of the second opening portion 32 as described above, the carrying direction of the developing agent carried by the supply auger 10 is reversed near the second opening portion 32 and then the developing agent is carried in the opposite direction by the agitating auger 11. Thus, there is turbulence in the developing agent near the second opening portion 32. Consequently, when the toner is supplied in a location where there is turbulence in the flow of the developing agent, there is the merit that the developing agent and the toner are well mixed by the influence of this turbulence. However, as mentioned earlier, since a large amount of developing agent is present near the second opening portion 32, the toner may be carried while floating on top of the developing agent if the toner is supplied in that area. By supplying the toner near the second opening portion 32 but in a region where there is slightly less developing agent, the toner that is supplied to a region near the second opening portion 32 having slightly less developing agent is first mixed in with a small amount of developing agent and further mixed by being drawn into a region near the second opening portion 32 having a large amount of developing agent. In the present embodiment, the toner is not supplied from above where the developing agent is carried in the developing agent holding chamber 91, but rather the toner is supplied from a side area to which the developing agent is carried. The region referred to here, which is near the second opening portion but has less developing agent than other regions and in which the toner is drawn into a region near the second opening portion having a large amount of developing agent, is the region S2 shown in FIG. 5B.

It should be noted that although it has been described that "the developing agent holding chambers 90 and 91 and the toner holding chamber 92 are positioned on substantially the same plane," here "substantially the same plane" refers to a positional relationship of the toner holding chamber 92, the developing agent holding chamber 91, and the developing agent holding chamber 90 in which there is a possibility that the developing agent positioned near the second opening portion 32 of the developing agent holding chamber 91 and the developing agent holding chamber 90 will backflow through the first opening portion 31 to the toner holding chamber 92 when the rotation type development apparatus 1 rotates.

The above-described embodiment may be modified as follows.

As described above, since the developing agent holding chamber 91 and the toner holding chamber 92 are linked by the first opening portion 31, there may be occasions when backflow of the developing agent into the toner holding chamber 92 cannot be completely prevented. Accordingly, the following configuration is preferable.

In order to ensure that the developing agent held in the developing agent holding chamber 91 does not backflow into the toner holding chamber 92, a solution has been proposed in JP 2000-56568A for example, in which a magnet is provided on a rear surface side of the dispensing auger as viewed from a toner supply opening corresponding to the first opening portion of the present embodiment and the magnetic force thereof is made to effect from the dispensing auger to the toner supply opening. Due to the effect of this magnet, at times other than during toner supply, the developing agent is pulled near the toner supply opening such that the toner supply opening can be obstructed. By doing this, it is possible to prevent backflow of the developing agent and it is also possible to prevent the toner being excessively supplied from the toner holding chamber to the developing agent holding chamber.

However, a magnet having a considerably strong magnetic force is necessary to effect a magnetic force on the comparatively wide region from the dispensing auger to the toner supply opening. According to tests carried out by the present inventors, when a magnet having a considerably strong magnetic force is used, developing agent attached by magnetic force near the toner supply opening sometimes does not drop into the developing agent holding chamber, even when the dispensing auger is rotated at the time of toner supply, and therefore the toner supply opening may remain obstructed. This reduces the toner supply capability remarkably. Furthermore, particularly when the toner is supplied from the side of the developing agent in the developing agent holding chamber 91 as shown in FIG. 2, it is difficult to separate the developing agent stuck by a magnet such as in JP 2000-56568A using gravity at the time of toner supply. Thus, the reduction in toner supply capability is even more notable.

The following configuration may be used to address this problem.

Figure 6:
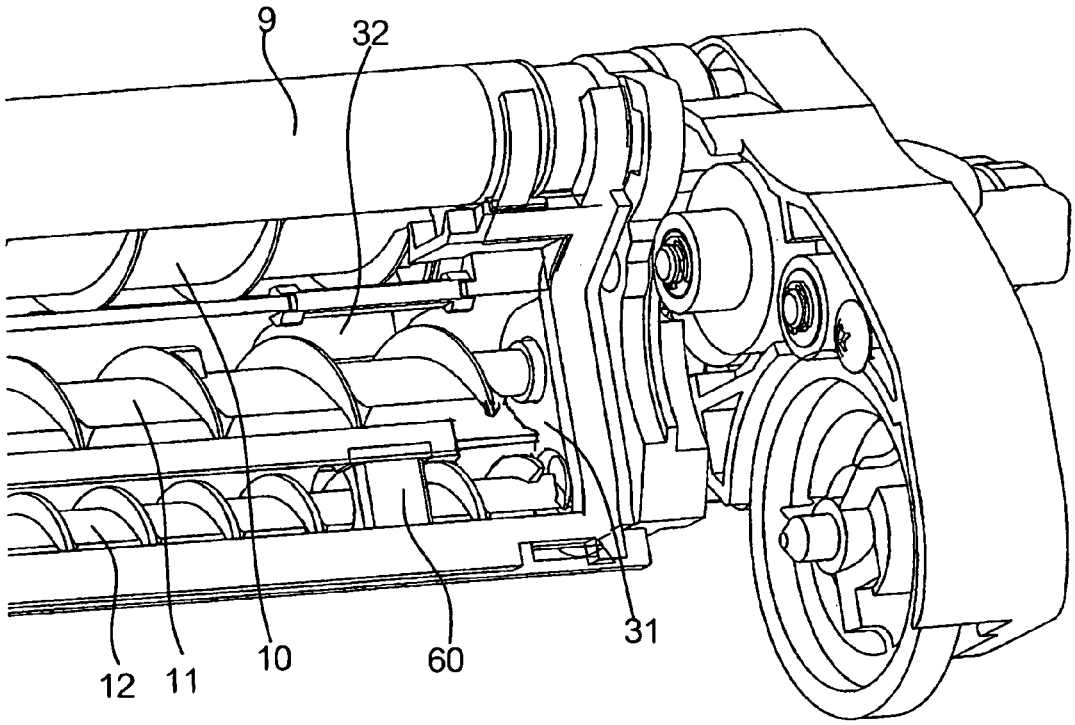
FIG. 6 is a perspective view of a vicinity of a first opening portion.
Figure 7:
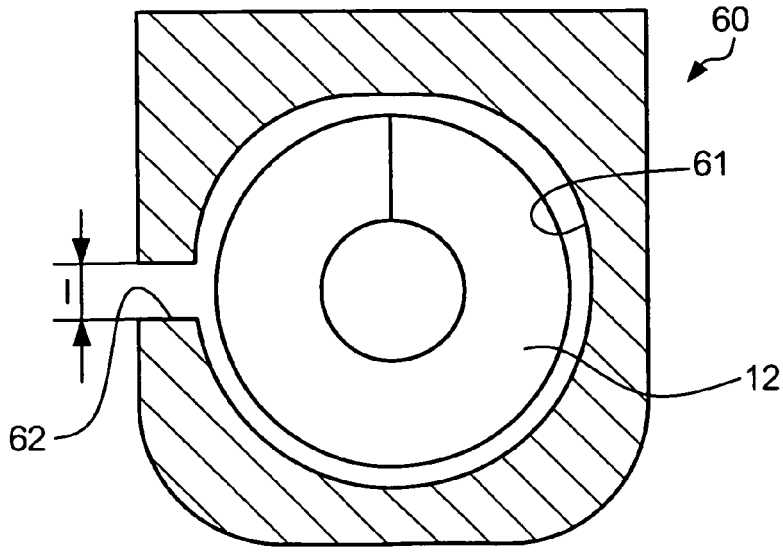
FIG. 7 is a top view in a direction parallel to an axis of a dispensing auger.

FIG. 6 is a perspective view of the vicinity of the first opening portion 31 and FIG. 7 is a top view as viewed from a direction parallel to an axis of the dispensing auger 12.

As shown in FIG. 6, a magnet 60 is provided in a position of a certain distance away from the first opening portion 31 toward an upstream side in the toner carrying direction. The distance between the first opening portion 31 and the magnet 60 is a distance by which the effect of the magnetic force of the magnet 60 does not extend to the space near the first opening portion 31. More specifically, the distance between the first opening portion 31 and the magnet 60 is a distance of a value such that the magnetic force of the magnet 60 does not hinder the movement of the developing agent at the position of the first opening portion 31.

As shown in FIG. 7, the magnet 60 is provided with an aperture 61 through which the dispensing auger 12 passes. By having the dispensing auger 12 pass through the aperture 61, the circumference of the dispensing auger 12 is covered by the magnet 60. N poles and S poles are alternately magnetized on the inner surface of the aperture 61 along a direction parallel to the shaft of the dispensing auger 12. It is preferable that the magnetic force at the inner surface of the aperture 61 is not less than 200 gauss and not greater than 1,000 gauss. Furthermore, it is preferable that the pitch of the magnetic poles is approximately 6 mm in consideration of the size of the magnetic force effected on the toner. When the pitch is too wide, the magnetic effect extends to an inner side of the vanes of the dispensing auger 12 and the toner carrying capability is affected, but on the other hand, when the pitch is too narrow, the magnetic effect becomes weak and the effectiveness of preventing backflow of the developing agent is reduced. Furthermore, the distance between the outer edge of the vanes of the dispensing auger 12 and the inner surface of the aperture 61 is approximately 1 mm to 10 mm (preferably about 1 mm) in consideration of such factors as abrasion between the dispensing auger 12 and the inner surface of the aperture 61 and the range of magnetic effect of the magnet 60 on the dispensing auger 12. It should be noted that a groove 62 is provided in a portion of the magnet 60 as shown in FIG. 7, but this is a groove for holding a protruding member inside the toner holding chamber 92 so that the magnet 60 is fastened to the holding chamber. Since the magnetic force is reduced in the vicinity of the groove portion for longer lengths l of the groove portion, it is preferable that the length l of the groove portion is not greater than 10 mm.

It should be noted that the rotation type development apparatus 1 and the development roll 9 are rotated in a counterclockwise direction in the configuration shown as an example in FIGS. 1 and 2, but a configuration in which the rotation type development apparatus 1 and the development roll 9 rotate clockwise is also possible.

Furthermore, in the configuration shown as an example in FIG. 1, four arm portions arranged at 90 degree angles are provided on the rotation shaft 5 and the developer vessels 2Y, 2M, 2C, and 2K are fastened respectively to these arm portions. However, there is no limitation to this and in order to increase the capacity of the toner cartridge in which the very frequently used K (black) toner is held, the angle formed by the arm portion on which the developer vessel for K toner is fastened and the other arm portions may be made larger than the angles formed by the other arm portions. For example, the angle formed by the arm portion on which the developer vessel for K toner is fastened and another arm portion may be set to 126 degrees, while the angles formed by the other arm portions may be set to 78 degrees.

Instead of inside the rotatable body 3, the toner cartridges shown in FIGS. 3A and 3B may be attached outside the rotatable body 3. By this arrangement, the angles between the arm portions can be kept uniform at 90 degrees while only the toner cartridge for K toner standing out from the surface of the rotatable body 3.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention in various embodiments and with various modifications as are suited to the particular use contemplated. It is intended that the scope of the invention be defined by the following claims and their equivalents.

What is claimed is:

1. A developer vessel comprising:

a developing agent supporter that supports a developing agent containing a toner and a carrier;

a second developing agent holding chamber that holds the developing agent supplied to the developing agent supporter;

a first developing agent holding chamber that holds the developing agent, the first developing agent holding chamber being housed adjacent to the second developing agent holding chamber;

a first partition that divides the first and the second developing agent holding chambers, the first partition having a second opening portion and a third opening portion;

a first carrying member and a second carrying member, both of which cause the developing agent held in the first developing agent holding chamber and the second developing agent holding chamber to circulate between the first developing agent holding chamber and the second developing agent holding chamber by allowing the developing agent to pass through the second and the third opening portions;

a toner holding chamber that holds the toner supplied to the first developing agent holding chamber, the toner holding chamber being housed adjacent to the first developing agent holding chamber, and arranged in a position facing the second developing agent holding chamber through the first developing agent holding chamber, and;

a second partition that divides the first developing agent holding chamber and the toner holding chamber, the second partition having a first opening portion through which the toner supplied from the toner holding chamber to the first developing agent holding chamber passes, the second opening portion arranged towards an upstream end portion of the first developing agent holding chamber in a direction in which the developing agent is carried by the first carrying member and the third opening portion arranged towards a downstream end portion of the first developing agent holding chamber in a direction in which the developing agent is carried by the first carrying member, the first opening portion arranged between the second opening portion and the upstream end of the first developing agent holding chamber in a direction in which the developing agent is carried by the first carrying member;

the developer vessel being used in a rotation type development apparatus in which a plurality of developing agent supporters are arranged along a circumference of a rotatable body, and development is carried out by causing the rotatable body to rotate such that one of the plurality of developing agent supporters is moved to a position facing an image carrier.

2. The developer vessel according to claim 1, further comprising:

a toner carrying unit in the toner holding chamber adapted to rotate on a rotation shaft and carry the toner to the first opening portion along a shaft direction and discharges from the first opening portion; and a magnetic body that covers a circumference of the toner carrying unit and is arranged adjacent to the first opening portion of the toner holding chamber.

3. The developer vessel according to claim 1, wherein:

the first carrying member agitates and carries the developing agent from the first opening portion to the second opening portion; and the second carrying member agitates and carries the developing agent from the second opening portion to the third opening portion.

4. A developer vessel comprising:

a developing agent supporter that supports a developing agent containing a toner and a carrier;

a second developing agent holding chamber that holds the developing agent to be supplied to the developing agent supporter;

a first developing agent holding chamber that is adjacent to the second developing agent holding chamber and holds the developing agent;

a first partition that divides the first and the second developing agent holding chambers, the first partition having a second opening portion and a third opening portion;

a first carrying member and a second carrying member, both of which cause the developing agent held in the first developing agent holding chamber and the second developing agent holding chamber to circulate through the second and the third opening portions;

a toner holding chamber that holds the toner supplied to the first developing agent holding chamber, the toner holding chamber being housed adjacent to the first developing agent holding chamber, and arranged in a position facing the second developing agent holding chamber through the first developing agent holding chamber, and;

a second partition that divides the first developing agent holding chamber and the toner holding chamber, the second partition having a first opening portion through which the toner supplied from the toner holding chamber to the first developing agent holding chamber passes;

the first opening portion being arranged in a position such that the toner from the toner holding chamber is supplied to a region having less developing agent than other regions inside the first developing agent holding chamber;

the developer vessel being used in a rotation type development apparatus in which a plurality of developing agent supporters are arranged along a circumference of a rotatable body, and development is carried out by causing the rotatable body to rotate such that one of the plurality of developing agent supporters is moved to a position facing an image carrier.

5. The developer vessel according to claim 4, further comprising:

a toner carrying unit in the toner holding chamber that is adapted to rotate on a rotation shaft and carry the toner to the first opening portion along a shaft direction and discharges from the first opening portion; and a magnetic body that covers a circumference of the toner carrying unit and is arranged adjacent to the first opening portion of the toner holding chamber.

6. The developer vessel according to claim 4, wherein:

the first carrying member agitates and carries the developing agent from the first opening portion to the second opening portion; and the second carrying member agitates and carries the developing agent from the second opening portion to the third opening portion.

* * * * *